US009427028B1

(12) United States Patent
Martin

(10) Patent No.: US 9,427,028 B1
(45) Date of Patent: Aug. 30, 2016

(54) FOOT HOSIERY SYSTEM FEATURING TOENAILS

(71) Applicant: Barbara Martin, Greer, SC (US)

(72) Inventor: Barbara Martin, Greer, SC (US)

( * ) Notice: Subject to any disclaimer, the term of this patent is extended or adjusted under 35 U.S.C. 154(b) by 386 days.

(21) Appl. No.: 13/949,525

(22) Filed: Jul. 24, 2013

(51) Int. Cl.

| | |
|---|---|
| ***A41B 11/00*** | (2006.01) |
| ***A43B 17/00*** | (2006.01) |
| ***A41D 27/08*** | (2006.01) |
| ***A41B 11/12*** | (2006.01) |

(52) U.S. Cl.
CPC ..... *A41B 11/001* (2013.01); *A41B 11/123* (2013.01)

(58) Field of Classification Search
CPC ... A41B 11/001; A41B 11/10; A41B 11/004; A41B 11/123; A45D 31/00
USPC ..... 2/239–241, 244, 246
See application file for complete search history.

(56) References Cited

U.S. PATENT DOCUMENTS

| | | | | |
|---|---|---|---|---|
| 3,143,870 | A | 8/1964 | Smith | |
| 3,887,946 | A | 6/1975 | Laskin et al. | |
| 4,304,108 | A * | 12/1981 | Chamlee | D04B 1/106 2/239 |
| 5,386,710 | A * | 2/1995 | Moore | A44C 15/009 63/15.9 |
| 5,867,838 | A | 2/1999 | Corry | |
| 6,120,202 | A * | 9/2000 | Donsky | A45D 34/045 401/17 |
| 6,153,139 | A * | 11/2000 | Marquette | A61F 2/5046 264/219 |
| D488,918 | S | 4/2004 | Mays | |
| D610,791 | S | 3/2010 | Chang | |
| 7,819,721 | B1 * | 10/2010 | Messier | A41D 27/08 2/244 |
| 7,954,176 | B2 | 6/2011 | Mennes | |
| D655,908 | S | 3/2012 | Eakin | |
| 2003/0074718 | A1 | 4/2003 | English | |
| 2007/0295349 | A1 * | 12/2007 | Simpson | A45D 31/00 132/73 |
| 2009/0042476 | A1 | 2/2009 | Chancey | |
| 2009/0293896 | A1 * | 12/2009 | Simpson | F21K 2/06 132/73 |
| 2010/0275942 | A1 * | 11/2010 | Barile | A45D 29/001 132/200 |
| 2012/0030862 | A1 * | 2/2012 | Swanson | A41B 11/001 2/239 |
| 2014/0041098 | A1 * | 2/2014 | Spector | A45D 31/00 2/239 |

* cited by examiner

*Primary Examiner* — Alissa L Hoey
*Assistant Examiner* — Jameson Collier

(57) ABSTRACT

A hosiery system for giving the appearance of well-groomed feet featuring a pair of stockings at least ankle-high wherein toenails are disposed on the stockings and are positioned to align with and lay atop the user's own toenails. Elastic surrounds the opening of the stockings and the elastic is concealed by a piece of jewelry such as an anklet.

1 Claim, 4 Drawing Sheets

FOOT HOSIERY SYSTEM FEATURING TOENAILS

BACKGROUND OF THE INVENTION

Many women believe they have unattractive feet and/or do not have time to maintain pedicures. The present invention features a hosiery system for an individual's feet designed to give the appearance of well-groomed feet. The system allows an individual to wear open-toed shoes comfortably and confidently.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
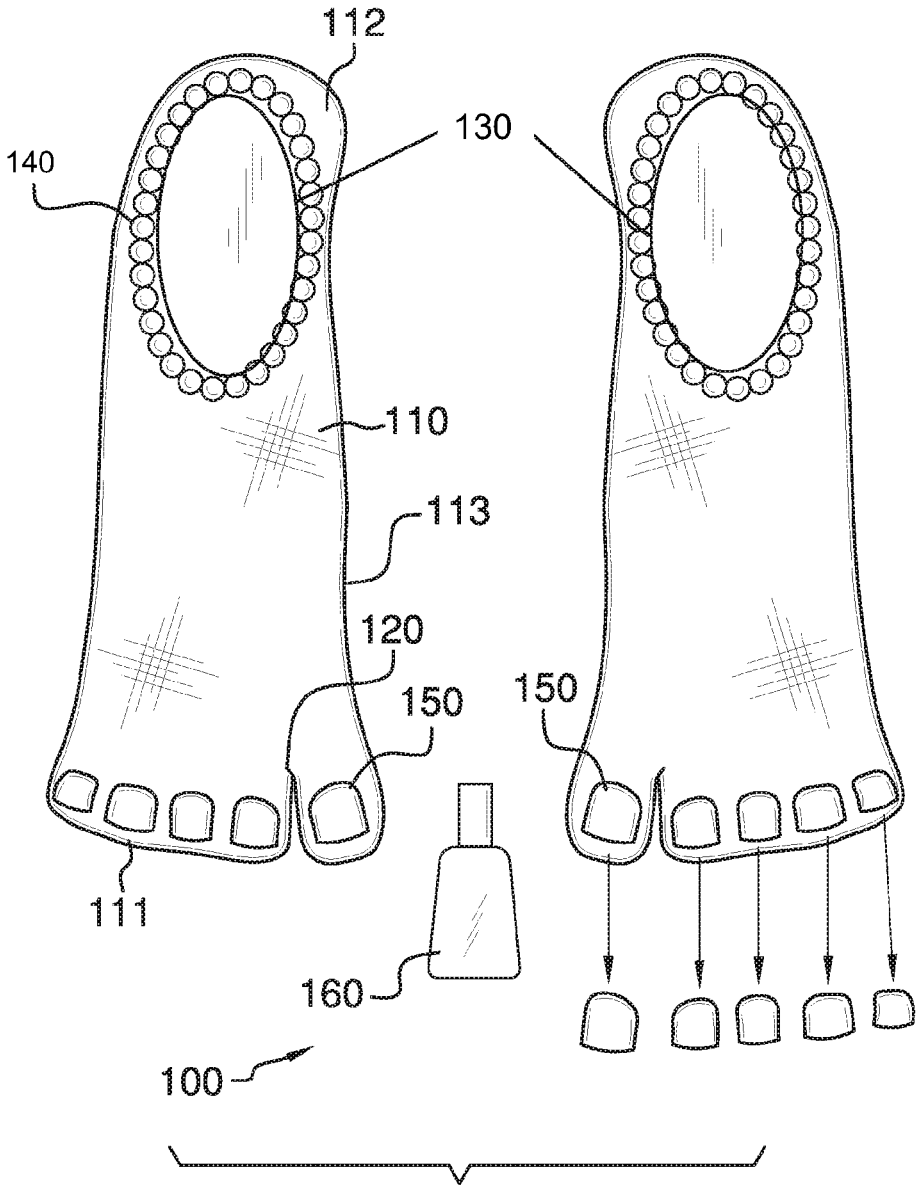
FIG. 1 shows a top view of the system of the present invention.
Figure 2:
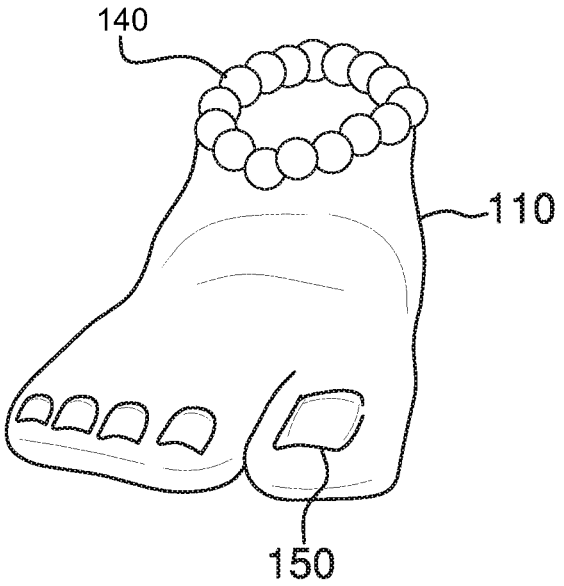
FIG. 2 shows a front view of the system of the present invention.
Figure 3:
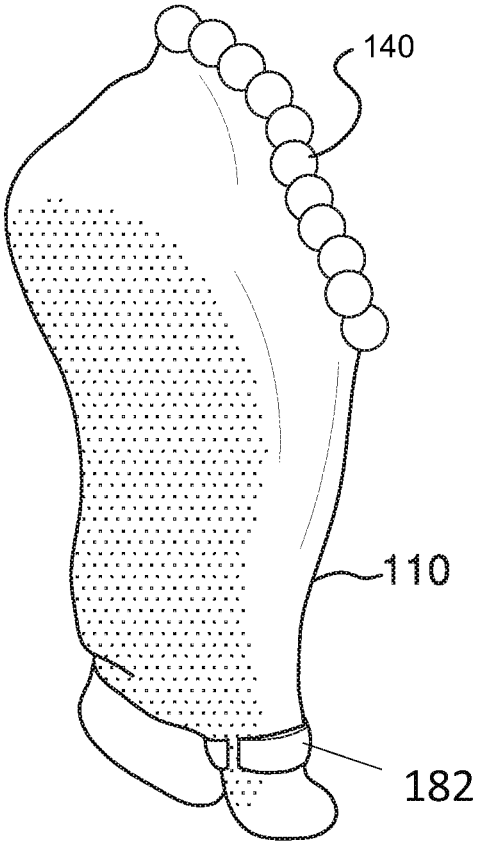
FIG. 3 shows a bottom perspective view of the system of the present invention.

Following is a list of elements corresponding to a particular element referred to herein:

100 hosiery system
110 stocking
111 toe end of stocking
112 ankle end of stocking
113 inner side of stocking
115 top surface of stocking
118 hole in ankle end of stocking
120 slit
130 elastic
140 jewelry ring
150 toenail
160 nail polish
170*a* first half attachment means
170*b* second half attachment means
180 string
182 toe ring Referring now to FIG. 1-7, the present invention features a hosiery system designed to give the appearance of well-groomed feet. The system (100) comprises a pair of stockings (110), e.g., a first stocking and a second stocking. The stockings (110) are adapted to cover a foot. Each stocking (110) has a toe end (111) and an ankle end (112). In some embodiments, the ankle end (112) is open, e.g., a hole (118) is disposed in the ankle end (112) to allow a user to insert his/her foot into the stocking (110).

The stockings (110) may be designed to be ankle length as shown in FIG. 1-5. However, the stockings (110) are not limited to this length. For example, in some embodiments, the stockings (110) are knee-high, thigh-high, or hip-high (e.g., like standard panty hose). In some embodiments, like socks and shoes, the stockings (110) are constructed in various sizes to accommodate varying sizes of user's feet.

The stockings (110) may be constructed in a variety of colors and shades to accommodate variations in skin colors. In some embodiments, the stockings (110) are transparent enough so as to blend in with the user's skin.

Disposed on the toe end (111) of the stocking (110) is a slit (120). The slit (120) is positioned near the inner side (113) of the stocking (110) and functions to partition off a portion of the toe end (111) of the stocking (110) to accommodate the user's big toe.

Disposed on the top surface (115) of the stocking (110) at the toe end (111) are toenails (150). For example, as shown in FIG. 1, five toenails (150) are disposed on the top surface (115) of the stocking (110). Four toenails (150) are disposed on the stocking (110) on one side of the slit (120) (e.g., a second side of the slit) and a single toenail (150) is disposed on the stocking on the opposite side of the slit (120) (e.g., the first side of the slit). The toenails (150) are designed to lie atop (or lie near) the user's real toenails. The user may wish to move and reposition the stocking around on his/her foot to align the toenails adequately.

Figure 4:
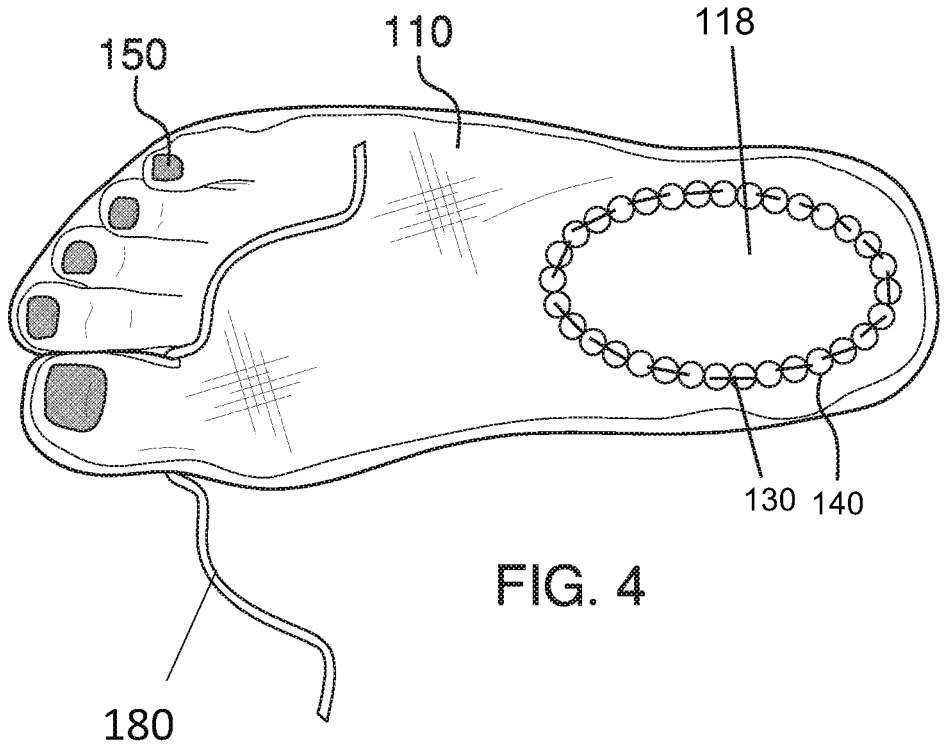
FIG. 4 shows a top view of the system of the present invention.
Figure 5:
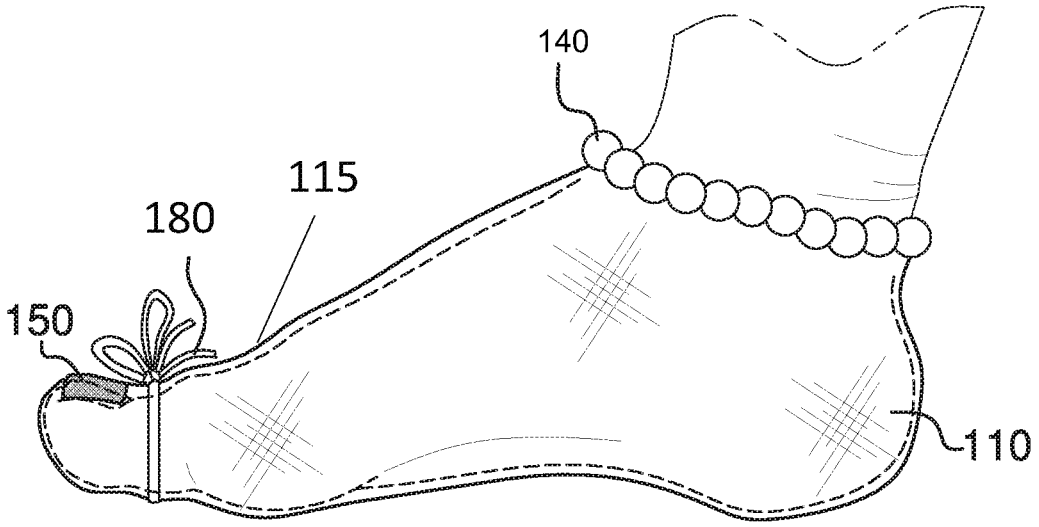
FIG. 5 shows a side view of the system of the present invention.
Figure 6:
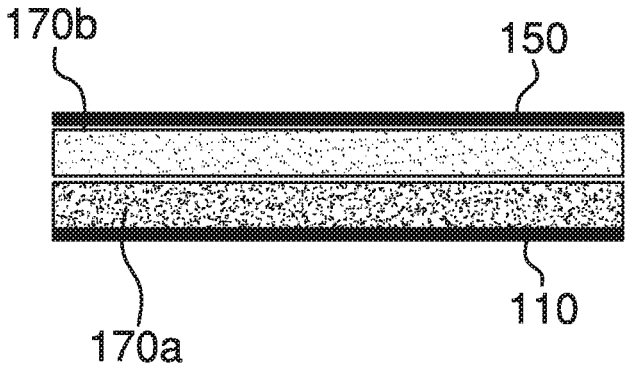
FIG. 6 shows a side cross sectional view of the system of the present invention.
Figure 7:
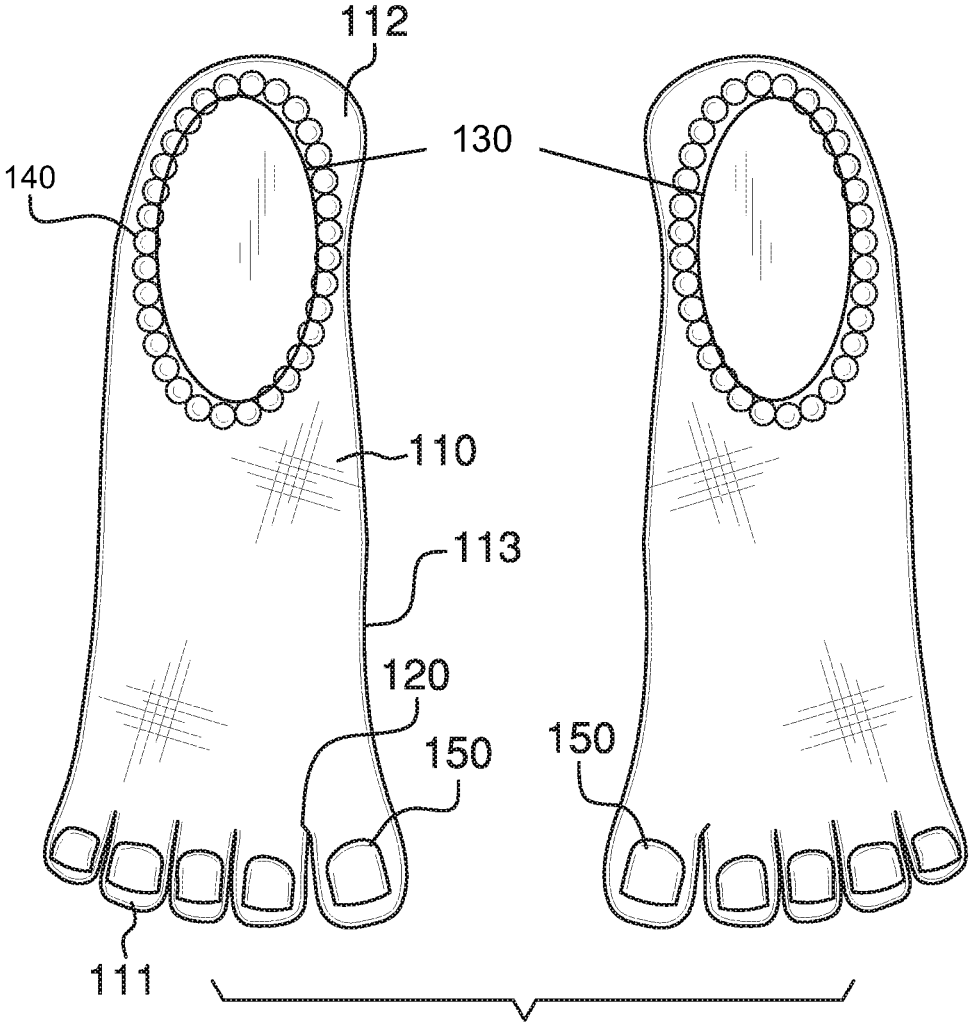
FIG. 7 shows a top view of the system of the present invention.

As shown in FIG. 4 and FIG. 5, in some embodiments, a string is disposed on the stocking (110), for example at or near the toe end (111), adjacent to the slit (120), at the base of the slit (120), etc. The string (180) may be tied as shown in FIG. 5. In some embodiments, the string (180) is attached to the bottom surface of the stocking (110), e.g., the portion of the toe end (111) of the stocking (110) that accommodates the user's big toe. In some embodiments, a toe ring (182) is wrapped around the portion of the toe end (111) of the stocking (110) that accommodates the user's big toe (see FIG. 3). In some embodiments, the string (180) is adhere to the toe region of the stocking as shown in FIG. 4.

In some embodiments, the system (100) further comprises a bottle of nail polish (160), for example for a user to paint the toenails (150) disposed on the stocking (110). In some embodiments, the toenails (150) on the stocking (110) are pre-painted.

In some embodiments, the toenails (150) may be removably attached to the top surface (115) of the stocking (110) (e.g., see FIG. 1, right side). For example, in some embodiments, a first half attachment means (170*a*), e.g., a hook-and-loop fastener, may be disposed on the top surface (115) of the stocking (110), and a second half attachment means (170*b*), e.g., a hook-and-loop fastener, may be disposed on the bottom of the toenail (150), wherein the first half attachment means (170*a*) and the second half attachment means (170*b*) are adapted to temporarily engage each other (see FIG. 6).

The hole (118) is lined with elastic (130) so as to help secure the stocking (110) on the user's foot. In some embodiments, a jewelry ring (140), e.g., an anklet, a ring of beads, etc., lines the elastic (130) so as to cover the elastic (130) and help the system (100) appear natural. In some embodiments, the jewelry ring (140) surrounds the entire hole (118) (and elastic (130)). In some embodiments, the jewelry ring (140) surrounds a portion of the hole (118) (and elastic (130)).

As used herein, the term "about" refers to plus or minus 10% of the referenced number.

The disclosures of the following U.S. Patents are incorporated in their entirety by reference herein: U.S. Pat. No. 5,867,838; U.S. Pat. No. 7,954,176; U.S. Pat. No. 3,143,870: U.S. Pat. No. 3,887,946; U.S. Design Pat. No. D610,791; U.S. Design Pat. No. D655,908; U.S. Design Pat. No. D488,918; U.S. Pat. Application No. 2009/0042476; U.S. Pat. Application No. 2003/0074718.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hosiery system (100) for giving an appearance of well-groomed feet, said hosiery system (100) consisting of:

(a) a pair of stockings (110), each stocking (110) adapted to respectively cover one of a user's feet, each stocking has a toe end (111) and an ankle end (112), wherein a hole (118) is disposed in each ankle end (112) of each stocking (110) to allow a user to insert a respective foot into the stocking (110);

(b) an elastic member (130) disposed in each stocking (110), wherein each elastic member (130) respectively surrounds each hole (118) in each ankle end (112) of each stocking (110), each elastic member (130) is configured to help to secure the respective stocking (110) on the user's foot;

(c) a jewelry ring (140) disposed in each stocking (110), wherein each jewelry ring (140) respectively surrounds at least a portion of each elastic member (130);

(d) a slit (120) disposed in each toe end (111) of each stocking (110), each slit (120) positioned near an inner side (113) of each stocking (110), each slit (120) functions to partition a portion of each toe end (111) of each stocking (110) and is configured to accommodate a user's big toe;

(e) a string (180) disposed on each stocking (110), wherein each string (180) is disposed on a surface of the portion of each toe end (111) of each stocking (110) that is configured to accommodate the user's big toe, each string (180) configured to wrap around the respective big toe of the user's feet;

(f) a first artificial toenail (150) removably disposed on a top surface (115) of each stocking (110) at each toe end (111) of each stocking (110) on a first side of each slit (120), and four additional artificial toenails (150) disposed on the top surface (115) of each stocking (110) at each toe end (111) of each stocking (110) on a second side of each slit (120), the artificial toenails are positioned to respectively align with respective ones of the user's toenails when the stockings (110) are worn; wherein a first half attachment means (170*a*) is disposed on the top surface (115) of each stocking (110) and a second half attachment means (170*b*) is disposed on a bottom surface of each of the five artificial toenails (150), wherein the first half attachment means (170*a*) and the second half attachment means (170*b*) are adapted to temporarily engage each other, wherein the first half attachment means (170*a*) and the second half attachment means (170*b*) are mateable hook-and-loop fasteners; wherein each stocking (110) is configured to provide an enhanced appearance to a respective one of the user's feet.

* * * * *